United States Patent [19]

Cook et al.

[11] 3,984,725

[45] Oct. 5, 1976

[54] PERMANENT MAGNET STRUCTURE FOR CROSSED-FIELD TUBES

[75] Inventors: Alfred W. Cook, Andover; Thomas H. Schultz, S. Hamilton, both of Mass.

[73] Assignee: Varian Associates, Palo Alto, Calif.

[22] Filed: May 19, 1975

[21] Appl. No.: 578,576

[52] U.S. Cl. ..... 315/39.51; 313/157; 315/39.75; 315/39.71; 335/210

[51] Int. Cl.[2] ..... H01J 25/50

[58] Field of Search ..... 315/39.71, 39.75, 39.51; 313/157; 335/210

[56] References Cited

UNITED STATES PATENTS

| | | | |
|---|---|---|---|
| 2,235,517 | 3/1941 | Espe | 313/157 |
| 2,615,143 | 10/1952 | Brown | 315/39.71 X |
| 3,346,766 | 10/1967 | Feinstein | 315/39.71 |
| 3,376,466 | 4/1968 | Gerard | 315/39.75 X |
| 3,412,285 | 11/1968 | Gerard | 315/39.75 X |
| 3,493,810 | 2/1970 | Valles | 315/39.71 X |
| 3,843,904 | 10/1974 | Brown | 315/39.71 |
| 3,855,498 | 12/1974 | MacMaster et al. | 315/39.71 |

*Primary Examiner*—Saxfield Chatmon, Jr.
*Attorney, Agent, or Firm*—Stanley Z. Cole; Richard B. Nelson

[57] ABSTRACT

A permanent magnet structure particularly beneficial for generating the interaction field in coaxial, crossed field electron tubes is designed such that the normal iron flux return path is not required. Substantial reduction in weight results. A further benefit is that a magnetron interaction structure including the magnets may be built as a unit replaceable in the field in a stabilizing cavity structure. Since the cavity structure contains no iron, the magnets are not demagnetized in the replacement process and there are no mechanical mounting problems caused by magnetic forces.

22 Claims, 2 Drawing Figures

PERMANENT MAGNET STRUCTURE FOR CROSSED-FIELD TUBES

FIELD OF THE INVENTION

The invention relates to crossed field electron tubes for generating microwave energy. Such tubes generally have, as part of their package, permanent magnets to produce the electron beam directing field. Many of the tubes are used in military and airborne systems where weight is an important factor, and the magnet structure forms a large part of the weight of the tube package.

PRIOR ART

Magnetron oscillators and crossed field amplifier tubes have generally used permanent magnets. In prior art tubes the magnetic circuit contained, in series: a vacuum gap in which the useful interaction field is developed, ion polepieces to direct the field in the gap, permanent magnet material for generating the field, and an iron return path for the flux. The field strength required in microwave tubes is generally so high that the length of permanent magnet material in the direction of magnetization is considerably greater than the useful gap length. Thus a large amount of leakage flux occurs outside the useful gap, necessitating larger cross sectional areas of magnet material and iron return path to carry the extra flux. In other words, even when the magnetic material is operated at its maximum B × H product point it is not used at maximum efficiency because field energy is stored in the leakage flux field.

An example of prior art magnetic circuits employing iron return paths is described in U.S. Pat. No. 3,392,308 issued July 9, 1968 to E. J. Cook and assigned to the present assignee.

A somewhat different prior art magnetic circuit is described in U.S. Pat. No. 3,843,904 issued Oct. 22, 1974 to William C. Brown. In Brown's tube the leakage field is reduced by positioning the permanent magnet inside the toroidal interaction space so that a separate flux return path outside the interaction space is not required. A disadvantage of this arrangement is that the cross section and the length of magnet material are limited so that a very expensive material such as samarium-cobalt is required. Also, severe problems of cooling the material arise, the above mentioned samarium-cobalt being very easily damaged by high temperatures. Brown's magnet is the topological equivalent of a horseshoe magnet, being formable by straightening out a horseshoe.

Horseshoe magnets have also been used outside the interaction space, as shown in U.S. Pat. No. 3,543,082 issued Nov. 24, 1970 to H. Boehm.

SUMMARY OF THE INVENTION

An objective of the present invention is to provide a crossed field tube with reduced total weight of permanent magnet circuit.

A further objective is to provide a tube with integral magnets which is easily field-replaceable in an external stabilizing cavity.

The above objectives are met in the present invention by providing a pair of permanent magnets on opposite sides of the interaction space. The magnets are magnetized in the same direction, generally perpendicular to the electron stream, to produce a generally uniform field in the gap between them. The return flux between the outer ends of the magnets passes through the air, vacuum and non-magnetic materials of the rest of the tube structure. The added weight of an iron return path in prior art tubes is eliminated with only a small reduction in useful field strength, which can be regained by a small increase in the amount of permanent magnet material.

In one embodiment of the present invention the cathode and anode structure of a magnetron oscillator are encased in a vacuum envelope and assembled with cylindrical magnets at the ends of the interaction space. This interior subassembly is mounted in an external subassembly structure comprising a high-Q stabilizing cavity with its tuner and a microwave output circuit. The interior assemblage can be easily replaced in the field. Since the external structure is non-magnetic there is no demagnetizing force as the interior assemblage is moved into it. There are also no strong magnetic attraction forces such as in prior devices which often required elaborate mechanisms for seating the parts.

The invention will be illustrated by embodiments in coaxial magnetrons. However it will be apparent to those skilled in the art that it may be applied to any other kind of crossed-field microwave tube, such as linearly disposed amplifiers and circularly disposed amplifiers having either re-entrant or non-re-entrant beams.

DESCRIPTION OF PREFERRED EMBODIMENTS

Figure 1:
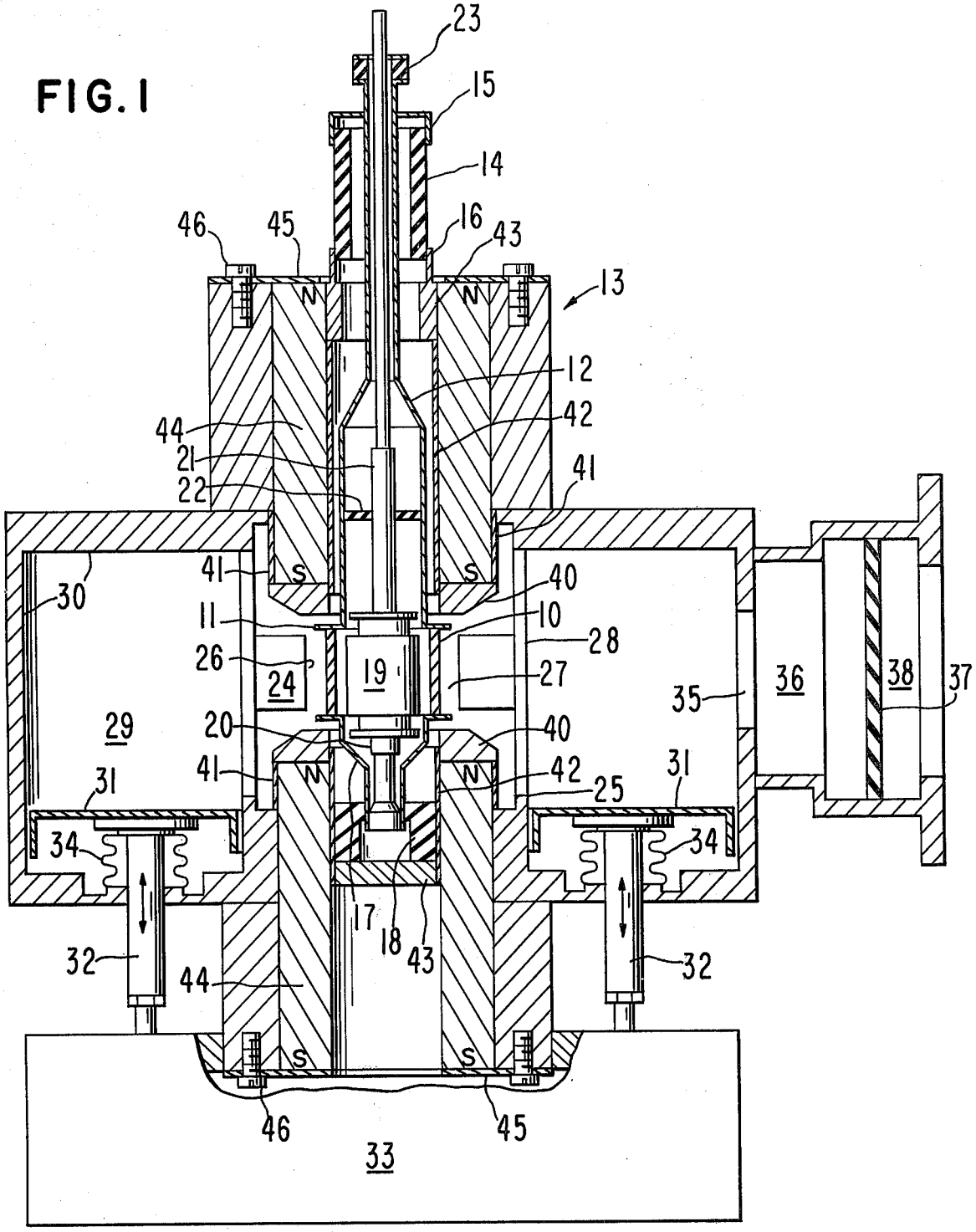
FIG. 1 is a partly schematic cross-section through the axis of a coaxial magnetron oscillator embodying the invention.

The magnetron of FIG. 1 has a cylindrical cathode emitter 10 as of tungsten impregnated with barium aluminate. At each end of emitter 10 is a projecting cathode end hat 11 of non-emitting material such as molybdenum. The cathode is supported at one end on a cathode stem structure 12 which is mounted on the body 13 of the magnetron via an insulating seal 14 as of alumina ceramic sealed at each end, as by brazing, to thin metallic lips 15, 16 as of iron-nickel-cobalt alloy. At the other end the cathode is supported by an extended support stem 17 slidably contained against motion transverse to its axis in a ceramic sleeve 18 which is in turn contained within tube body structure 13.

Cathode emitter 10 is heated by a radiant heater 19, as of cermet, mounted on current-carrying leads 20, 21. Lead 20 is joined as by spotwelding to cathode stem 17. Lead 21 is centered in the cathode stem 12 by a disc-shaped ceramic insulator 22 and extends through the vacuum envelope via a coaxial ceramic seal 23 which insulates lead 21 from cathode stem 12.

Surrounding emitter 10 is a coaxial circular array of anode vanes 24 as of copper extending inward from an anode cylinder 25 as of copper. The inner ends 26 of vanes 24 lie on a cylinder defining the outer wall of a toroidal interaction space 27. Vanes 24 are regularly spaced circumferentially to define, between adjacent vanes, cavities resonant at approximately the desired frequency of oscillation.

On the outside wall of alternate cavities, axial slots 28 are cut through anode cylinder 25, connecting with a coaxial toroidal stabilizing cavity 29. The walls 30 of cavity 29 are preferably of copper to conductively cool vanes 24 and to provide a high Q-factor for frequency stabilization. Cavity 29 is tuned by a ring-shaped plate 31 which is axially movable by a plurality of push-rods 32 driven in unison by an external tuning drive mechanism 33 (shown schematically). Rods 32 are sealed to the cavity wall 30 by axially deformable metal bellows 34 to provide relative motion within the vacuum.

Cavity 29 is coupled by an iris 35 to a rectangular output waveguide 36 which is sealed off vacuum tight by a disc-shaped window 37 in a short section of circular waveguide 38.

Axially displaced on opposite sides of emitter 10 and vanes 24 are coaxial ferromagnetic polepieces 40 as of mild steel, sealed at their outside as by brazing to thin walled non-magnetic tubes 41 as of austenitic stainless steel which are in turn brazed to tube body 13. Polepieces 40 are sealed at their insides to coaxial thin-walled non-magnetic tubes 42 which in turn are sealed to end rings 43, as of austenitic steel, which complete the vacuum envelope and support the cathode structure.

Hollow cylindrical permanent magnets 44 are positioned in the annular spaces between tubes 41 and 42, preferably after the tube has been evacuated and baked. Magnets 44 are held in place by cover plates 45 and screws 46. Magnets 44 are magnetized axially before positioning in the tube and are oriented so that opposite poles are presented to the opposite ends of interaction space 27 and a generally uniform, generally axial magnetic field is produced in interaction space 27. Magnets 44 and polepieces 40 constitute the entire magnetic circuit. All other large parts are of non-magnetic material.

In operating the magnetron, a.c. heater current is passed between heater lead 23 and cathode lead 15. Voltage is applied to cathode lead 15, pulsed negative with respect to the grounded tube body and anode vanes 24. Electrons are drawn from cathode emitter 10 toward vanes 24 and are directed by the crossed magnetic field into paths circulating around the toroidal interaction path 27 where they interact with fringing microwave electric fields of the inter-vane cavities and generate microwave energy.

Permanent magnets 44 are limited in cross-sectional area by the requirements that they must fit within the stabilizing cavity 29 and its tuning mechanism 31, 32, 34, and that they must fit around the cathode stem structure 12 and its supports 14, 15, 16. A magnet material with high residual induction is desirable, such as sold under the trade name of Alnico V-7 with 12,000 oersteds residual induction.

In the invention the total leakage flux is somewhat higher than in prior-art magnetic circuits with ferromagnetic flux return paths. In spite of this it was unexpectedly found that the total weight of the magnetic circuit could be drastically reduced with only a small sacrifice in field strength. For example, an S-band magnetron similar to the tube shown in FIG. 1 had a conventional mild steel return path weighing 10 kilograms and the complete tube weighed 59 kilograms. The magnetic interaction field strength was 1500 to 1600 gauss. When the tube was redesigned according to the present invention, the interaction field was 1100 to 1200 gauss and the total weight was reduced to 34 kilograms.

Figure 2:
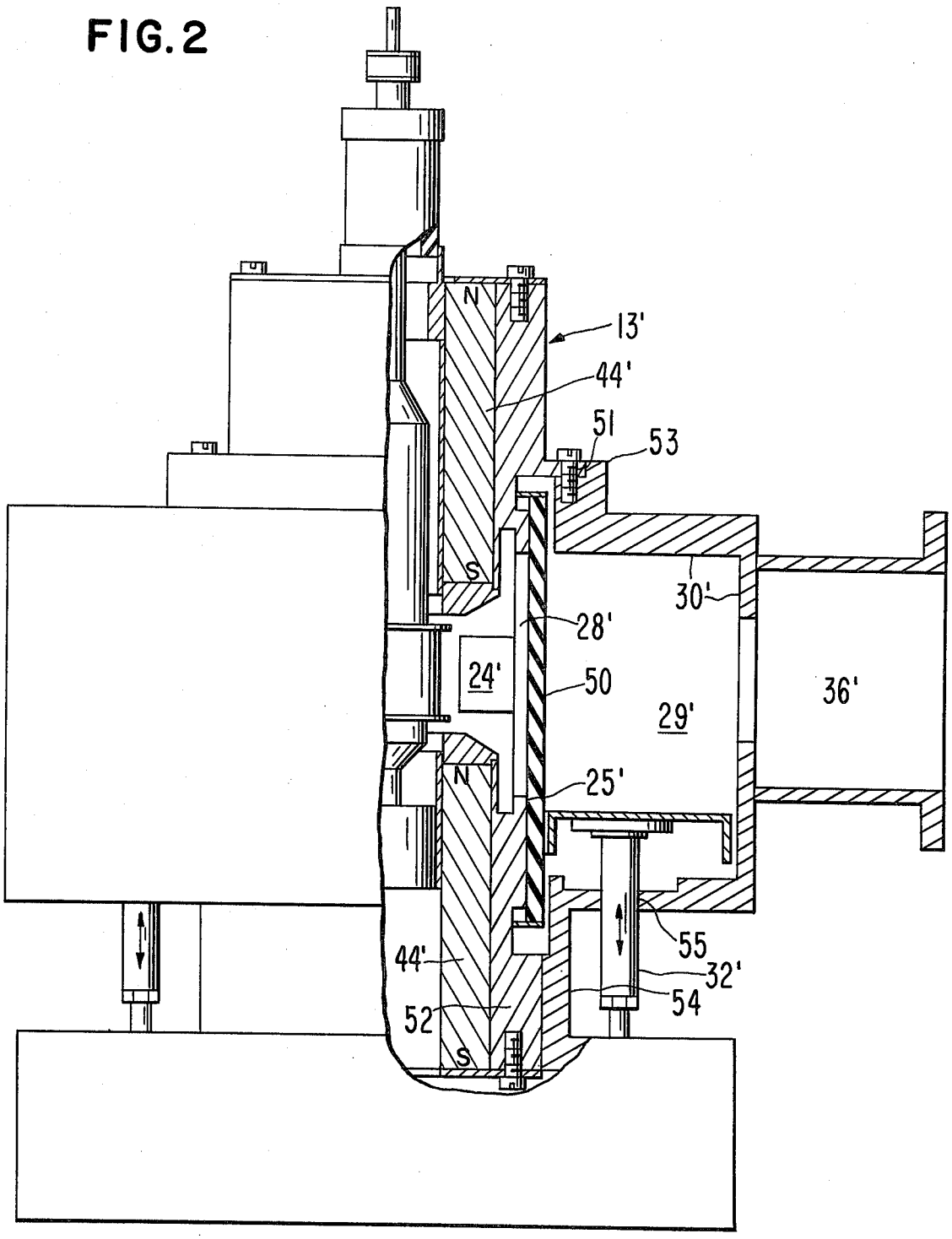
FIG. 2 is a partly schematic cross-section through the axis of a coaxial magnetron which is interchangeable in its stabilizing cavity.

FIG. 2 illustrates another embodiment of the invention wherein the vacuum envelope 13′ of the magnetron containing the interaction structure includes a dielectric cylindrical window 50 closely surrounding the anode cylinder 25′ so that the coupling slots 28′ in cylinder 25′ provide electromagnetic coupling, through window 50, between anode vanes 24′ and the external stabilizing cavity 29′. The outer surface of envelope 13′ has mounting flanges 51, 52 which fit slidably in lips 53, 54 of the cavity wall 30′.

Cavity 29′ is not part of the vacuum envelope, so its construction is not limited to the materials and processes suitable for evacuated devices. For example the cavity walls 30′ may be made of aluminum, thereby saving weight. Also, the metallic bellows 34 of FIG. 1 are not needed to transmit the tuner motion of rods 32′; a simple sliding bearing 55 is adequate. The waveguide window 37 of FIG. 1 is replaced by a straight section of waveguide 36′. Other parts of the magnetron are the same as shown in FIG. 1.

As in the tube shown in FIG. 1, the permanent magnets 44′ are mounted on the vacuum envelope 13′ after the tube is baked and exhausted. The subassembly of vacuum envelope and magnets is shipped as a unit and is replaceable in the field within the subassembly of the stabilizing cavity, tuning mechanism and output waveguide. Since the latter does not contain magnetic material there are no demagnetizing fields generated in the mounting process to alter the magnet charge. Also there are no physical forces of magnetic attraction, making hand mounting a simple operation requiring no jigs or positioning tools.

The invention clearly may be applied to other tubes, including all varieties of crossed-field microwave electronic tubes. The above illustrations of embodiment in magnetron oscillators are illustrative and not intended to be limiting.

What is claimed is:

1. A crossed field electron discharge device comprising:

cathode means including a cathode for generating a stream of electrons;

envelope means for maintaining a vacuum about said stream;

microwave circuit means for supporting electromagnetic fields in interactive relationship with said stream of electrons;

means for coupling electromagnetic wave energy from said circuit means;

means for applying an electric field between said cathode means and said circuit means;

means for applying a magnetic field perpendicular to said electric field in the region of said stream;

said means for applying said magnetic field comprising;

a pair of permanent magnet means on opposing sides of said stream of electrons, each of said magnet means having an inner end adjacent said stream of electrons, each of said magnet means having an outer end removed from said stream of electrons, the improvement wherein, said magnet means is disposed such that the return flux path between said outer ends is substantially through non-magnetic media.

2. The apparatus of claim 1 wherein said pair of magnet means is adapted to be magnetized in directions such that said inner ends are of opposite polarity and said outer end of each of said magnet means is of opposite polarity to the inner end thereof.

3. The apparatus of claim 1 wherein said pair of magnet means is structurally symmetric about a plane through the center of said electron stream.

4. The apparatus of claim 1 wherein said cathode means and said circuit means define therebetween an open re-entrant path adapted to contain said stream.

5. The apparatus of claim 4 wherein said re-entrant path is generally toroidal.

6. The apparatus of claim 5 wherein the surfaces of said cathode means and said circuit means defining the inner and outer surfaces of said toroid lie generally on concentric cylinders.

7. The apparatus of claim 5 wherein said magnet means are toroidal about the axis of said toroid.

8. The apparatus of claim 7 wherein said magnet means are cylinders.

9. The apparatus of claim 8 wherein at least one of said cylinders is hollow.

10. The apparatus of claim 5 wherein said pair of magnet means is structurally symmetric about a plane perpendicular to the axis of said toroid.

11. The apparatus of claim 1 wherein said magnet means comprise a pair of ferromagnetic polepieces facing said stream, said polepieces being of ferromagnetic material having low residual magnetization.

12. A crossed field electron discharge device comprising:

interaction subassembly means for generating electromagnetic energy, output subassembly means for controlling the frequency of said electromagnetic energy and for delivering said energy to a useful load, and mounting means for removably attaching said interaction subassembly means to said output subassembly means, said interaction subassembly means comprising;

cathode means including a cathode for generating a stream of electrons, primary circuit means for supporting electromagnetic fields in interactive relationship with said stream, means for generating an electric field between said cathode means and said circuit means, means for generating a magnetic field perpendicular to said electric field in the volume of said stream, envelope means for maintaining a vacuum about said cathode means and said primary circuit means, said envelope means including window means for coupling said electromagnetic fields through said envelope means, said output subassembly means for controlling said frequency including resonant cavity means coupled to said electromagnetic fields of said primary circuit means, said means for generating said magnetic field comprising a pair of permanent magnets on opposing sides of said stream, said magnetic having inner poles of opposite polarity adjacent said stream, said magnets having outer poles removed from said stream, the flux return path between said outer poles being through substantially non-magnetic media.

13. The apparatus of claim 12 wherein said permanent magnets are outside said vacuum envelope.

14. The apparatus of claim 12 wherein said cavity means includes adjustable tuning means for varying said frequency.

15. The apparatus of claim 12 wherein said cavity means is adapted to support a $TE_{01}$ mode.

16. The apparatus of claim 12 wherein said cathode means and said circuit means define therebetween an open re-entrant path adapted to contain said stream.

17. The apparatus of claim 16 wherein said re-entrant path is generally toroidal.

18. The apparatus of claim 17 wherein the surfaces of said cathode means and said circuit means defining the inner and outer surfaces of said toroid lie generally on concentric cylinders.

19. The apparatus of claim 17 wherein said magnet means are toroidal about the axis of said toroid.

20. The apparatus of claim 19 wherein said magnet means are cylinders.

21. The apparatus of claim 20 wherein at least one of said cylinders is hollow.

22. The apparatus of claim 12 wherein said pair of magnet means is structurally symmetric about a plane perpendicular to the axis of said toroid.

* * * * *

UNITED STATES PATENT AND TRADEMARK OFFICE

CERTIFICATE OF CORRECTION

PATENT NO. : 3,984,725

DATED : October 5, 1976

INVENTOR(S) : Alfred W. Cook; Thomas H. Schultz

It is certified that error appears in the above-identified patent and that said Letters Patent are hereby corrected as shown below:

Column 6, line 13: Change "magnetic" to --magnets--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*